US012606945B2

(12) United States Patent
Shibata et al.

(10) Patent No.: US 12,606,945 B2
(45) Date of Patent: Apr. 21, 2026

(54) SEWING SYSTEM, NON-TRANSITORY COMPUTER-READABLE MEDIUM, AND SEWING MACHINE

(71) Applicant: BROTHER KOGYO KABUSHIKI KAISHA, Nagoya (JP)

(72) Inventors: Kazuki Shibata, Nagoya (JP); Kazutaka Imaizumi, Nagoya (JP); Yoshihiro Minematsu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/610,439

(22) Filed: Mar. 20, 2024

(65) Prior Publication Data

US 2024/0328050 A1 Oct. 3, 2024

(30) Foreign Application Priority Data

Mar. 30, 2023 (JP) ..... 2023-055694

(51) Int. Cl.

| | |
|---|---|
| ***D05B 19/08*** | (2006.01) |
| ***D05B 19/10*** | (2006.01) |
| ***D05C 5/02*** | (2006.01) |
| *D05B 55/00* | (2006.01) |

(52) U.S. Cl.

CPC ..... *D05B 19/08* (2013.01); *D05B 19/10* (2013.01); *D05C 5/02* (2013.01); *D05B 55/00* (2013.01)

(58) Field of Classification Search

CPC ..... D05B 19/08; D05B 19/10; D05C 5/02

See application file for complete search history.

(56) References Cited

U.S. PATENT DOCUMENTS 5,896,822 A * 4/1999 Futamura ..... D05B 19/08 112/102.5

2017/0306542 A1* 10/2017 Kongo ..... D05B 19/08

FOREIGN PATENT DOCUMENTS

JP 2003-326010 A 11/2003

* cited by examiner

*Primary Examiner* — Nathan E Durham

(74) *Attorney, Agent, or Firm* — OLIFF PLC

(57) ABSTRACT

A sewing system is provided with a sewing machine and a terminal device capable of communicating with the sewing machine. The terminal device includes an input portion, a device processor, and a device memory. The device memory stores computer-readable instructions that, when executed by the device processor, instruct the device processor to perform processes. The processes executed by the device processor include acquiring sewing data including needle drop position data representing needle drop positions when sewing an embroidery pattern using the sewing machine, receiving an edit operation, on the input portion, to edit the embroidery pattern, transmitting, to the sewing machine, at least some of the sewing data, before terminating the receiving the edit operation, and transmitting, to the sewing machine, edit data according to the edit operation, after starting the transmitting the at least some of the sewing data.

10 Claims, 6 Drawing Sheets

SEWING SYSTEM, NON-TRANSITORY COMPUTER-READABLE MEDIUM, AND SEWING MACHINE

REFERENCE TO RELATED APPLICATIONS

This application claims priority from Japanese Patent Application No. 2023-055694 filed on Mar. 30, 2023. The entire content of the priority application is incorporated herein by reference.

BACKGROUND ART

The present disclosure relates to a sewing system, a non-transitory computer-readable medium and a sewing machine.

A known sewing machine is provided with an operation panel for making various settings necessary for sewing, and a sewing machine control device that controls the sewing machine based on operation commands from the operation panel. The operation panel is provided with a communication device that receives sewing data from a terminal device, a storage device that stores the received sewing data, and a display device that displays a sewing data editing screen for editing the received sewing data. The operation panel ascertains that the sewing data has been received from the terminal device and displays that fact on the display device.

SUMMARY

In a known sewing system, depending on a communication environment between the sewing machine and the terminal device and a volume of the sewing data, there is a possibility that a relatively long stand-by time may occur from the start of transmission of the sewing data, from the terminal device to the sewing machine, to when the transmission of the sewing data is complete. If the stand-by time is long, a user cannot smoothly start the sewing.

Embodiments of the broad principles derived herein provide a sewing system, a non-transitory computer-readable medium, and a sewing machine that, compared to known art, reduce a stand-by time caused by the transmission and reception of sewing data, in a sewing system in which the sewing data is transmitted to a sewing machine from a terminal device and the sewing machine sews an embroidery pattern based on the transmitted sewing data.

Embodiments provide a sewing system that is provided with a sewing machine and a terminal device capable of communicating with the sewing machine. The terminal device includes an input portion, a device processor, and a device memory. The device memory stores computer-readable instructions that, when executed by the device processor, instruct the device processor to perform processes. The processes executed by the device processor include acquiring sewing data including needle drop position data representing needle drop positions when sewing an embroidery pattern using the sewing machine, receiving an edit operation, on the input portion, to edit the embroidery pattern, transmitting, to the sewing machine, at least some of the sewing data, before terminating the receiving the edit operation, and transmitting, to the sewing machine, edit data according to the edit operation, after starting the transmitting the at least some of the sewing data. The sewing machine includes a needle bar that is configured to move up and down, a sewing processor, and a sewing memory. The sewing memory stores computer-readable instructions that, when executed by the sewing processor, instruct the sewing processor to perform processes. The processes executed by the sewing processor include receiving the sewing data transmitted by the terminal device, receiving the edit data transmitted by the terminal device, and controlling the needle bar to sew the embroidery pattern edited in accordance with the edit operation, based on the sewing data and the edit data. The terminal device of the sewing system transmits the sewing data in advance to the sewing machine during the editing of the embroidery pattern, and transmits separate edit data to the sewing machine after the editing is complete. The terminal device starts the transmission of the sewing data before the completion of the editing of the embroidery pattern. Thus, since the transmission of the sewing data is started earlier than in known art, even when a volume of the sewing data is relatively large, the terminal device contributes to reducing a stand-by time of a user from the completion of the editing to the start of the sewing.

Embodiments also provide a non-transitory computer-readable medium that stores computer-readable instructions that are executed by a device processor of a terminal device including an input portion and the device processor, the computer-readable instructions instructing the device processor to perform processes. The processes include acquiring sewing data including needle drop position data representing needle drop positions when sewing an embroidery pattern using a sewing machine, receiving an edit operation, on the input portion, to edit the embroidery pattern, transmitting, to the sewing machine, at least some of the sewing data, before terminating the receiving the edit operation, and transmitting, to the sewing machine, edit data according to the edit operation, after starting the transmitting the at least some of the sewing data. The terminal device starts the transmission of the sewing data before the completion of the editing of the embroidery pattern. Thus, since the transmission of the edit data is started earlier than in the known art, even when the volume of the sewing data is relatively large, the terminal device contributes to reducing the stand-by time of the user from the completion of the editing to the start of the sewing.

Embodiments further provide a sewing machine that includes a needle bar that is configured to move up and down, a sewing processor, and a sewing memory. The sewing memory stores computer-readable instructions that, when executed by the sewing processor, instruct the sewing processor to perform processes. The processes include receiving sewing data, the sewing data including needle drop position data representing needle drop positions when sewing an embroidery pattern, the sewing data being transmitted from a terminal device, receiving edit data according to an edit operation to edit the embroidery pattern, the edit data being transmitted from the terminal device, generating, after reception of both the sewing data and the edit data is complete, corrected data in which the needle drop position data are corrected based on the edit data, and controlling the needle bar to sew the embroidery pattern based on the corrected data. The sewing machine starts the reception of the sewing data transmitted from the terminal device during the editing of the embroidery pattern by the terminal device, and receives the intermediate edit data from the terminal device after the completion of the editing in the terminal device. The sewing machine starts the reception of the sewing data before the completion of the editing of the embroidery pattern. Thus, since the reception of the edit data is started earlier than in the known art, even when the volume of the sewing data is relatively large, the sewing machine contributes to reducing reduce the stand-by time of the user from the completion of the editing to the start of the sewing.

DESCRIPTION

Figure 1:
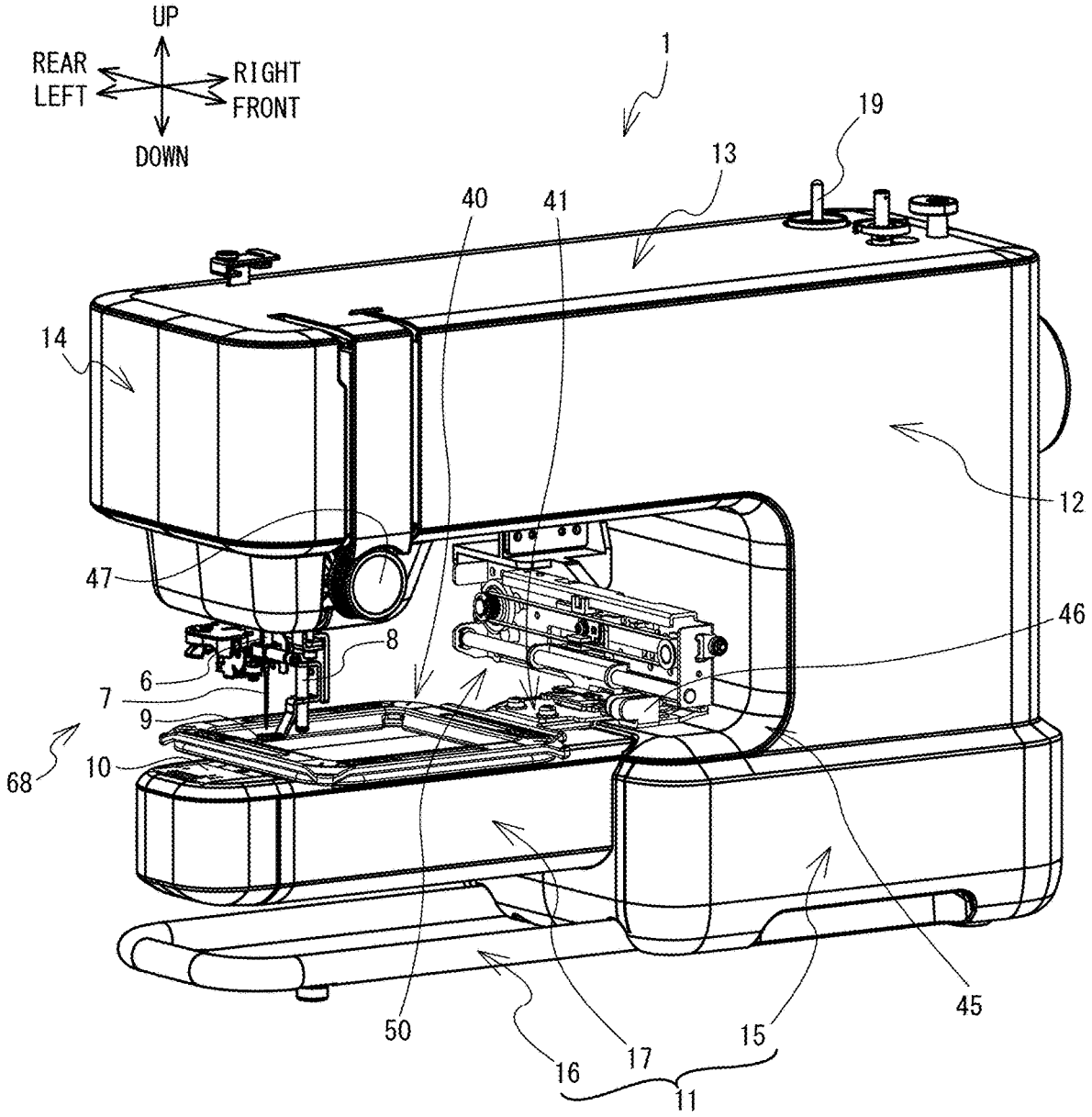
FIG. 1 is a perspective view of a sewing machine.

An embodiment of the present disclosure will be described with reference to the accompanying drawings. A configuration of a sewing machine 1 of a sewing system 4 (hereinafter referred to as the "system 4") according to the present embodiment will be described with reference to FIG. 1. The upper side, the lower side, the lower right side, the upper left side, the lower left side, and the upper right side in FIG. 1 are, respectively, the upper side, the lower side, the front side, the rear side, the left side, and the right side of the sewing machine 1. A lengthwise direction of a bed 11 and an arm 13 is a left-right direction of the sewing machine 1. A side at which a pillar 12 is disposed is the right side. An extending direction of the pillar 12 is the up-down direction of the sewing machine 1.

As shown in FIG. 1, the sewing machine 1 is provided with the bed 11, the pillar 12, the arm 13, a head 14, and a carriage 50. The bed 11 is a foundation of the sewing machine 1 that extends in the left-right direction. The bed 11 includes a base 15, a leg 16, and a free arm 17. The base 15 is a portion further to the right than substantially a center of the bed 11 in the left-right direction. The base 15 is internally provided with a sewing machine motor 76 shown in FIG. 2. The leg 16 is a circular rod portion formed in a U shape that is open to the right in plan view. The right end portions of the leg 16 are coupled to the lower portion of the left end portion of the base 15. The free arm 17 is a substantially square column portion extending to the left from the upper portion of the left end portion of the base 15. The sewing machine 1 is provided with a needle plate 10 at the upper surface of the free arm 17, and is provided with a shuttle mechanism and the like (not shown in the drawings) inside the free arm 17. The shuttle mechanism causes an upper thread (not shown in the drawings) and a lower thread (not shown in the drawings) to be entwined with each other below the needle plate 10.

The pillar 12 extends upward from the right end portion of the bed 11. Spool pins 19 are provided at the upper portion of the pillar 12. Thread spools (not shown in the drawings) around which the upper thread is wound, can be held by the spool pins 19. The arm 13 extends in parallel to the bed 11 toward the left from the upper end portion of the pillar 12. A drive shaft (not shown in the drawings) that extends in the left-right direction is provided inside the arm 13. The drive shaft is driven to rotate by the sewing machine motor 76. The head 14 is coupled to the left leading end portion of the arm 13. A sewing portion 68 that is configured to sew an embroidery pattern is provided at the head 14. The sewing portion 68 is provided with a needle bar 6, a needle bar mechanism 18 (refer to FIG. 2), and a presser bar 8. A sewing needle 7 is detachably mounted to the lower end of the needle bar 6. A presser foot 9 is detachably mounted to the lower end of the presser bar 8. The needle bar 6 is driven to move in the up-down direction by the rotation of the drive shaft.

A movement mechanism 45 is provided with a holder 46 and the carriage 50, and is configured to move the holder 46 to a position indicated by a unique XY coordinate system (an embroidery coordinate system). A X direction and a Y direction of the embroidery coordinate system respectively correspond to the left-right direction and the front-rear direction of the sewing machine 1. The carriage 50 is configured to move a sewing object, which is held by an embroidery frame 40, in the front-rear direction and the left-right direction relative to the needle bar 6. The carriage 50 is supported by a support portion provided inside the arm 13, and hangs down from the arm 13 so as to be able to move in the left-right direction. The carriage 50 is configured to move the holder 46 in the front-rear direction.

The embroidery frame 40 is a frame body holding the sewing object. The sewing object is a processing fabric, for example. The embroidery frame 40 according to the present embodiment has a substantially square shape in a plan view, but a rectangular, circular, or elliptical embroidery frame may be selected as appropriate in accordance with the embroidery pattern. A coupling portion 41 for coupling to the holder 46 of the carriage 50 is provided at the right side of the embroidery frame 40.

Figure 2:
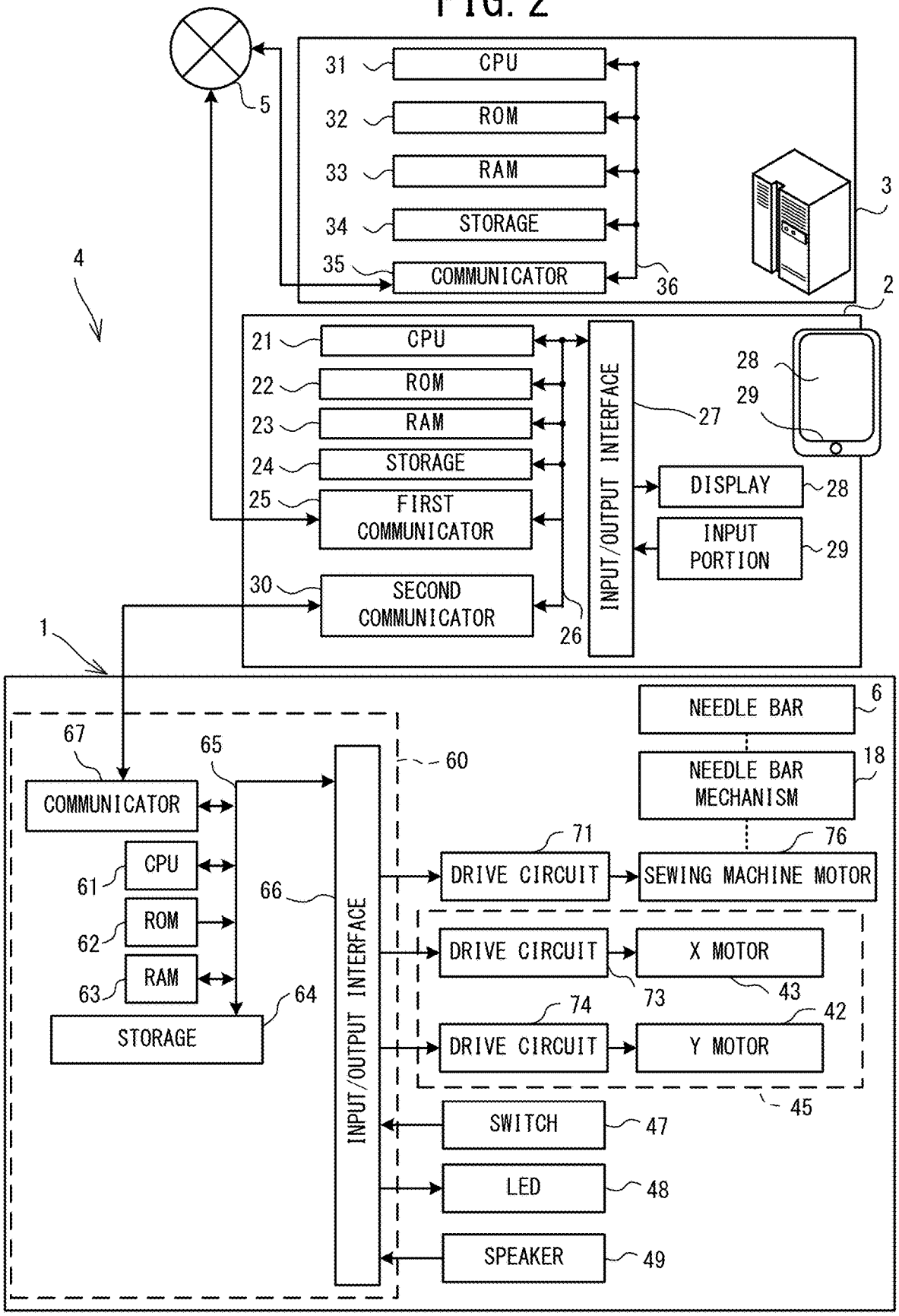
FIG. 2 is a block diagram showing an electrical configuration of a sewing system provided with the sewing machine and a terminal device, and of a server.

An electrical configuration of a server 3, and a terminal device 2 and the sewing machine 1 provided in the system 4 will be described with reference to FIG. 2. The system 4 is configured to be able to sew the embroidery pattern using the sewing machine 1, based on sewing data selected on the terminal device 2 using a web application provided by the server 3.

The server 3 is provided with a CPU 31, a ROM 32, a RAM 33, a storage 34, and a communicator 35. The CPU 31 controls the server 3. The CPU 31 is electrically connected to the ROM 32, the RAM 33, the storage 34, and the communicator 35 via a bus 36. A boot program, a BIOS, and the like are stored in the ROM 32. Temporary data are stored in the RAM 33. The storage 34 is a non-volatile storage device, such as an HDD, an SSD, and the like. The communicator 35 is an interface for connecting the server 3 to a network 5. The CPU 31 is configured to transmit and receive data with another device connected to the network 5 (the terminal device 2, for example), via the communicator 35.

The terminal device 2 is provided with a CPU 21, a ROM 22, a RAM 23, a storage 24, a first communicator 25, a second communicator 30, and an input/output interface 27. The CPU 21 controls the terminal device 2. The CPU 21 is electrically connected to the ROM 22, the RAM 23, the storage 24, the first communicator 25, the second communicator 30, and the input/output interface 27, via a bus 26. A boot program, a BIOS, and the like are stored in the ROM 22. Temporary data are stored in the RAM 23. The storage 24 is a non-volatile storage device. Various setting values necessary for performing terminal processing to be described later are stored in the storage 24. The first communicator 25 is an interface for connecting the terminal device 2 to the network 5. The CPU 21 is configured to transmit and receive data with another device connected to the network 5 (the server 3, for example), via the first communicator 25. The second communicator 30 is an interface for connecting the terminal device 2 to the sewing machine 1. The second communicator 30 is a near field communication protocol interface, such as Bluetooth (registered trademark). The input/output interface 27 is connected to a display 28 and an input portion 29. The display 28 is a liquid crystal display, for example. The input portion 29 is a touch screen, for example, and is used when inputting various commands.

A controller 60 of the sewing machine 1 is provided with a CPU 61, a ROM 62, a RAM 63, a storage 64, an input/output interface 66, and a communicator 67. The CPU 61 is connected to the ROM 62, the RAM 63, the storage 64, the input/output interface 66, and the communicator 67, via a bus 65. Drive circuits 71, 73, and 74, a switch 47, an LED 48, and a speaker 49 are connected to the input/output interface 66. The storage 64 is a non-volatile storage device. The storage 64 stores various setting values necessary for performing sewing machine processing to be described later. The communicator 67 is a near field communication protocol interface corresponding to the second communicator 30 of the terminal device 2. The CPU 61 is configured to transmit and receive data with the terminal device 2 via the communicator 67.

The sewing machine motor 76 is connected to the drive circuit 71. The drive circuit 71 drives the sewing machine motor 76 in accordance with a control signal from the CPU 61. In response to the driving of the sewing machine motor 76, the needle bar mechanism 18 is driven via the drive shaft (not shown in the drawings) of the sewing machine 1, and the needle bar 6 moves up and down. An X motor 43 is connected to the drive circuit 73. A Y motor 42 is connected to the drive circuit 74. The drive circuit 73 and the drive circuit 74 respectively drive the X motor 43 and the Y motor 42 in accordance with a control signal from the CPU 61. In response to the driving of the X motor 43 and the Y motor 42, the embroidery frame 40 mounted to the movement mechanism 45 moves in the left-right direction (the X direction) and the front-rear direction (the Y direction) by a movement amount corresponding to the control signal. The communicator 67 is an interface for connecting the sewing machine 1 to the terminal device 2. The switch 47 is used to instruct the start or stop of sewing. The LED 48 is disposed to the inside of the switch 47, and performs notification of an operational state of the sewing machine 1, using patterns of flashing, being illuminated, or being extinguished. The LED 48 according to the present embodiment includes two types of LED, namely, red and green. The operational state of the sewing machine 1 includes "Stopped," "Sewing," and "Sewing complete." The speaker 49 outputs sound.

Operations of the sewing machine 1 will be briefly described. In the sewing machine 1, the needle bar mechanism 18 and the shuttle mechanism are driven in coordination with the embroidery frame 40 being moved in the X direction and the Y direction by the movement mechanism 45. In this way, the embroidery pattern is sewn on the sewing object held by the embroidery frame 40, by the sewing needle 7 mounted to the needle bar 6.

The terminal processing and the sewing machine processing for sewing the embroidery pattern based on sewing data and edit data, by the CPU 21 of the terminal device 2 and the CPU 61 of the sewing machine 1 of the system 4 working in concert with each other, will be described in parallel with reference to FIG. 3 to FIG. 6. The terminal processing is processing performed by the CPU 21 of the terminal device 2. The sewing machine processing is processing performed by the CPU 61 of the sewing machine 1. Hereinafter, each of steps will be denoted by the abbreviation S. As an example, a case will be described in which an embroidery pattern E5 selected from among embroidery patterns E1 to E6 displayed on a screen G1 in FIG. 4 is sewn. The embroidery pattern E1 is a pattern of a grand piano sewn using threads of two colors. The embroidery pattern E2 is a pattern of a trumpet sewn using threads of two colors. The embroidery pattern E3 is a pattern of a quaver musical note sewn using a thread of one color. The embroidery pattern E4 is a pattern of a bunch of flowers sewn using threads of three colors. The embroidery pattern E5 is a pattern of a bunch of flowers sewn using threads of four colors. The embroidery pattern E6 is a pattern of a rose sewn using threads of three colors. Each of the embroidery patterns E1 to E6 according to the present embodiment include one or more partial patterns divided by each of the thread colors. At a stage at which the terminal processing and the sewing machine processing are started, communication between the terminal device 2 and the sewing machine 1 is already established.

The CPU 21 of the terminal device 2 displays the screen G1, as candidates for the embroidery pattern, on the display 28, and determines whether the embroidery pattern has been acquired based on an input result of the input portion 29 (S1). The screen G1 is provided with a field 81, and keys 82 and 83. The field 81 is a field displaying the candidates for the embroidery pattern, and includes thumbnail images of the embroidery patterns E1 to E6. The key 82 is selected when inputting a command to end the terminal processing. The key 83 is selected when outputting a command to acquire the embroidery pattern of a currently selected thumbnail image as the embroidery pattern to be edited. When the selection of the key 83 has not been detected and the embroidery pattern is not acquired (no at S1), the CPU 21 stands by at S1 until the embroidery pattern is acquired. A user selects the thumbnail image of the desired embroidery pattern E5, from among the thumbnail images of the embroidery patterns E1 to E6 displayed on the screen G1. When, in accordance with an operation F1 of the user, the selection of the key 83 has been detected in the state in which the embroidery pattern E5 is selected, and the embroidery pattern has been acquired (yes at S1), the CPU 21 transmits a confirmation request to the sewing machine 1 (S2). The confirmation request is a request transmitted from the terminal device 2 to the sewing machine 1 for confirming whether or not the sewing machine 1 is in a state of being able to perform sewing.

The CPU 61 of the sewing machine 1 stands by until the CPU 61 receives the confirmation request from the terminal device 2 (no at S31). When the confirmation request has been received (yes at S31), the CPU 61 transmits, to the terminal device 2 from which the confirmation request was transmitted, information indicating the state of the sewing machine 1 (S32). The information indicating the state of the sewing machine 1 is, for example, information indicating whether the sewing machine 1 is in the state of being able to perform the sewing.

Figure 6:
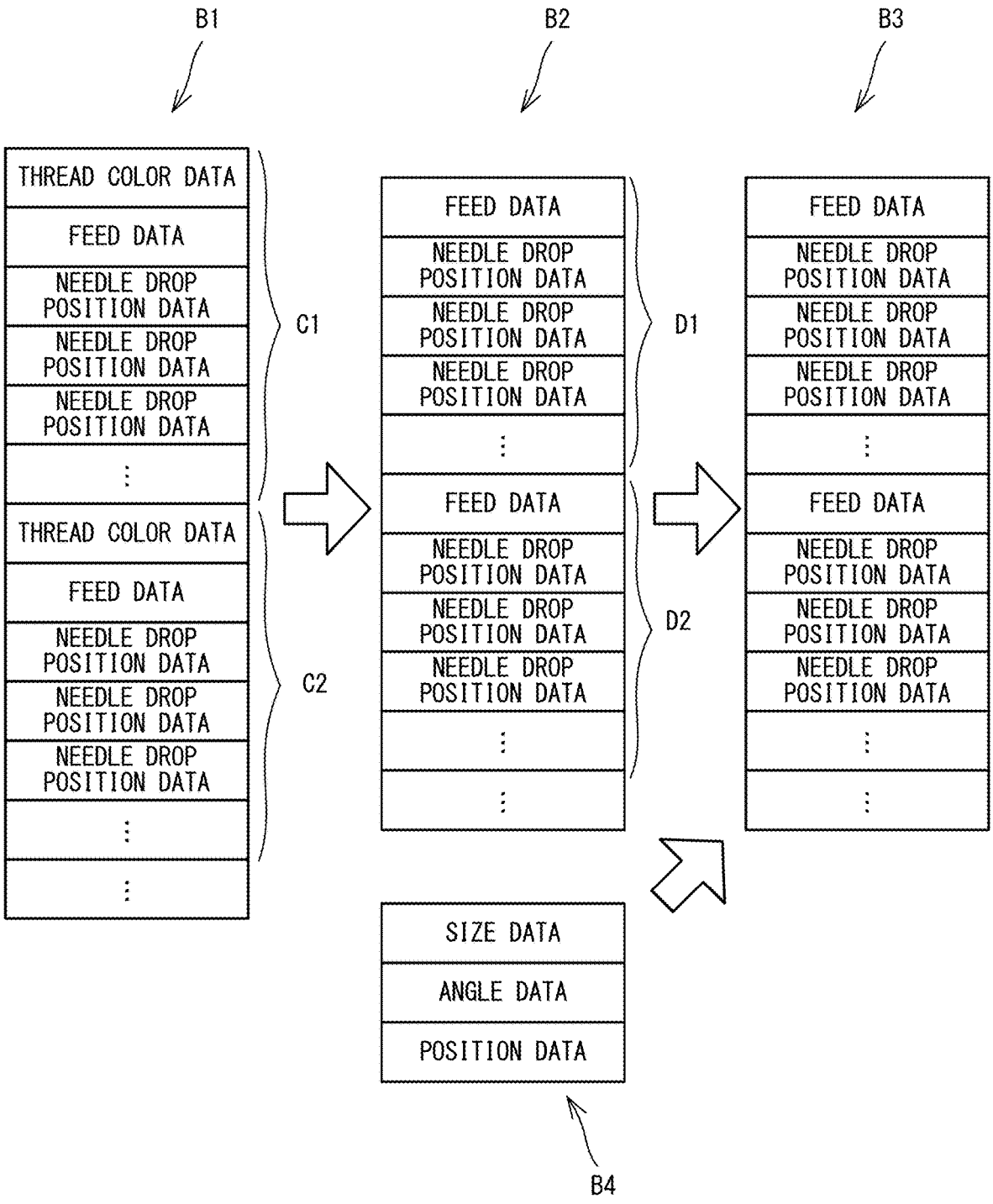
FIG. 6 is an explanatory diagram of sewing data, corrected data, and edit data.

The CPU 21 of the terminal device 2 acquires the sewing data including needle drop position data representing needle drop positions of stitches formed when sewing the embroidery pattern acquired at S1, using the sewing machine 1 (S3). As shown in FIG. 6, sewing data B1 includes a plurality of partial sewing data for sewing the partial patterns divided by each of the thread colors. The plurality of partial sewing data are stored in a sewing order. The plurality of partial sewing data, which include partial sewing data C1 and C2, respectively include thread color data, feed data, and the needle drop position data. The thread color data indicates the color of the thread for sewing the embroidery pattern. The feed data is data indicating a sewing start position of the partial pattern, using coordinates of the embroidery coordinate system. The needle drop position data is data indicating positions of needle drop points using coordinates of the embroidery coordinate system, and includes data groups representing a plurality of coordinates for each of the needle drop points. The sewing data may be data stored in the storage 24 of the terminal device 2, or may be data acquired from the server 3 in accordance with the acquisition of the embroidery pattern at S1.

The CPU 21 stands by until the CPU 21 receives the information indicating the state of the sewing machine 1 transmitted from the sewing machine 1 (no at S4), and when the information indicating the state has been received (yes at S4), the CPU 21 displays a screen G2 shown in FIG. 4 on the display 28, as a preview display (S5). As shown in FIG. 4, the screen G2 includes a field 84, and keys 85 and 86. The field 84 displays a sewing image when the embroidery pattern E5 acquired at S1 is sewn by the sewing machine 1. The size and shape of the field 84 corresponds to the size and shape of a sewing region set inside the embroidery frame 40 to be used by the sewing machine 1. The size and shape of the sewing region may be input by the user, or may be acquired from the sewing machine 1. The left-right direction and the up-down direction in the screen G2 respectively correspond to the X direction and the Y direction of the embroidery coordinate system. The arrangement of the embroidery pattern E5 with respect to the field 84 represents the arrangement of the embroidery pattern E5 with respect to the sewing region when the embroidery pattern E5 is sewn by the sewing machine 1. The key 85 is selected when cancelling the selection of the embroidery pattern E5. The key 86 is selected when editing the arrangement, namely, the size, the angle, and the position of the selected embroidery pattern E5 displayed in the field 84.

The CPU 21 stands by until the selection of the key 86 has been detected (no at S6). When, in accordance with an operation F2 of the user, the selection of the key 86 has been detected (yes at S6), the CPU 21 starts processing to transfer the selected sewing data to the sewing machine 1 (S7). After the processing at S3, by performing the processing at S7, the CPU 21 transmits at least some of the sewing data to the sewing machine 1 before the end of processing to receive an edit operation at S8. As shown in FIG. 6, the CPU 21 according to the present embodiment transmits, of the sewing data B1 acquired at S3, sewing data B2 including the needle drop position data to the sewing machine 1, and does not transmit the thread color data to the sewing machine 1. The sewing data B2 includes the plurality of partial sewing data including partial sewing data D1 and D2. The thread color data is not included in the sewing data B2, and the feed data and the needle drop position data are included.

The CPU 61 of the sewing machine 1 stands by until the CPU 61 receives the sewing data transmitted from the CPU 21 of the terminal device 2 (no at S33). When the reception of the sewing data has been detected (yes at S33), the CPU 61 starts the reception of the sewing data and successively stores the sewing data in the storage 64 (S34).

After starting the processing at S7, the CPU 21 displays a screen G3 shown in FIG. 4 on the display 28, and starts to receive an edit operation, on the input portion 29, to edit the embroidery pattern (S8). As shown in FIG. 4, the screen G3 includes the field 84, the key 85, and a key 87. The key 87 is selected when inputting a command to transfer the edit data, which represents the arrangement of the embroidery pattern E5, to the sewing machine 1. The user can input commands to edit the arrangement of the embroidery pattern E5 in the field 84. In the screen G3, the embroidery pattern E5 after the edit operation is displayed. The CPU 21 according to the present embodiment receives the edit operation of the arrangement, namely, the size, the angle, and the position of the embroidery pattern. The edit operation of the size of the embroidery pattern is implemented, for example, by the user performing a pinch operation of pinching the input portion 29 using two fingers. The edit operation of the angle and the position of the embroidery pattern is implemented, for example, by the user performing a swiping operation on the input portion 29 using a finger. In a specific example, when, in accordance with an operation F3 of the user to expand the size of the embroidery pattern E5 to 1.7 times, to rotate the embroidery pattern E5 by 20 degrees in the clockwise direction, and to move the embroidery pattern E5 to the left, the edit operation of the size, the angle and the position of the embroidery pattern E5 has been detected (yes at S8), the CPU 21 acquires the edit data corresponding to the edit operation, edits the embroidery pattern E5 based on the edit data, and, as shown by the screen G3, updates the embroidery pattern E5 displayed in the field 84 of the display 28 (S9).

As shown in FIG. 6, edit data B4 of the specific example includes size data indicating the size of the embroidery pattern, angle data indicating the angle of the embroidery pattern with respect to a reference angle, and position data indicating the position of the embroidery pattern with respect to a reference position. The size of the embroidery pattern is represented, for example, by an X length of a side extending in the X direction and a Y length of a side extending in the Y direction of a smallest rectangle that encompasses the embroidery pattern. The size data may represent the X length and the Y length. The reference angle and the reference position may be relative references, or may be absolute references. For example, the reference angle may be an initial angle of the embroidery pattern indicated by the sewing data acquired at S3. The reference position may be an initial position of the embroidery pattern indicated by the sewing data acquired at S3.

When the edit operation has not been detected (no at S8), or when the editing portion at S9 has been performed, the CPU 21 determines whether the selection of the key 87 has been detected (S10). When the selection of the key 87 has not been detected (no at S10), the CPU 21 determines whether the selection of the key 85 has been detected (S11). When the selection of the key 85 has not been detected (no at S11), the CPU 21 returns the processing to S8. When the selection of the key 85 has been detected (yes at S11), the CPU 21 transmits, to the sewing machine 1, a cancellation command notifying that the sewing based on the sewing data for which the transfer is started by the processing at S7 is cancelled (S12). As a result of the processing at S12, when, after the start of the processing at S8, the CPU 21 acquires the cancellation command to cancel the sewing of the embroidery pattern in accordance with the selection of the key 85, the cancellation command is transmitted to the sewing machine 1. When, in accordance with an operation F4 of the user, the selection of the key 87 has been detected (yes at S10), the CPU 21 transmits the edit data acquired at S9 to the sewing machine 1 (S13).

The CPU 61 of the sewing machine 1 determines whether the cancellation command transmitted from the terminal device 2 has been received (S35). When the cancellation command has been received (yes at S35), the CPU 61 invalidates the data already received from the terminal device 2, and does not perform the sewing based on the received data (S36). More specifically, the CPU 61 deletes the sewing data for which the reception is started at S34 from the storage 64 (S36), does not perform the sewing based on the sewing data for which the reception is started at S34, and returns the processing to S31.

When the cancellation command is not received (no at S35), the CPU 61 determines whether the reception of the edit data from the terminal device 2 has been detected (S37). When the reception of the edit data has not been detected (no at S37), the CPU 61 returns the processing to S35. When the reception of the edit data B4 has been detected (yes at S37), the CPU 61 receives the edit data B4 and stores the edit data B4 in the storage 64 (S38). After the reception of the sewing data B2 and the edit data B4 is complete, the CPU 61 responds to the terminal device 2, and transmits, to the terminal device 2, a reception complete notification indicating that the reception of the sewing data B2 and the edit data B4 is complete (S39). Therefore, when the reception of the sewing data started by the processing at S34 is complete, but the reception of the edit data by the processing at S38 is not yet complete, the CPU 61 does not perform the sewing processing at S47, to be described later, until the reception of the edit data is complete, and the CPU 61 performs the sewing processing at S47 after the reception of each of the sewing data and the edit data is complete. The CPU 61 causes the green LED 48 to flash (S40). The flashing of the green LED 48 indicates that the sewing machine 1 is in a stopped state.

The CPU 61 generates corrected data B3 in which the needle drop position data of the sewing data B2 for which the reception is complete are corrected based on the edit data B4 received at S38 (S41). When the edit data includes the angle data, the CPU 61 generates, based on the needle drop position data and the angle data, corrected data for sewing the embroidery pattern at the angle indicated by the angle data. When the edit data includes the position data, the CPU 61 generates, based on the needle drop position data and the position data, corrected data for sewing the embroidery pattern at the position indicated by the position data. When the edit data includes the size data, the CPU 61 generates, based on the needle drop position data and the size data, corrected data for sewing the embroidery pattern of the size indicated by the size data. When the edit data includes the size data, the CPU 61 may add or delete the needle drop position data such that a thread density of the embroidery pattern after the correction is within a predetermined range. The corrected data B3 may be generated separately from the sewing data B2 for which the reception is started at S34, or the corrected data B3 may be generated by updating the sewing data B2 in accordance with the edit data B4.

The CPU 21 of the terminal device 2 stands by until the CPU 21 receives the reception complete notification from the sewing machine 1 (no at S14). When the reception complete notification has been received from the sewing machine 1 (yes at S14), the CPU 21 starts processing to display a monitoring status 88 of the sewing machine 1 on the display 28 (S15). Based on the sewing data acquired at S3, a message 89 is displayed on the display 28 prompting the thread of the thread color of the first partial pattern in the sewing order, of the embroidery pattern E5, to be mounted to the sewing machine 1 (S16). As shown in FIG. 4, a screen G4 includes the monitoring status 88, the message 89, the field 84, and the key 85. The monitoring status 88 is displayed based on notification from the sewing machine 1. The message 89 is a message prompting thread replacement displayed based on the notification from the sewing machine 1.

Figure 5:
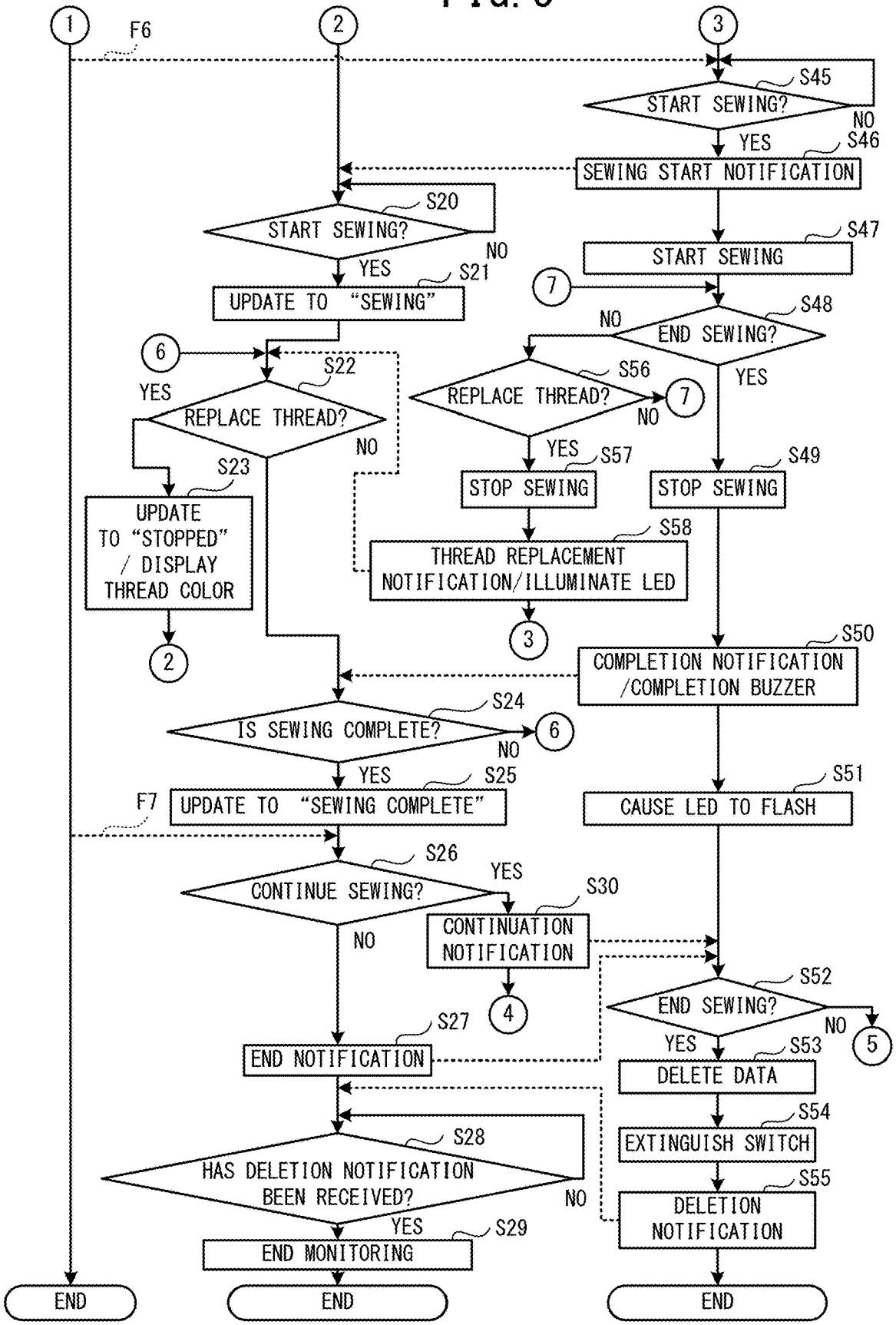
FIG. 5 is a flowchart of the terminal processing and the sewing machine processing performed by the sewing system.

As shown in FIG. 5, the CPU 61 of the sewing machine 1 stands by until a sewing start command has been detected (no at S45). After mounting, to the sewing machine 1, the thread of the thread color displayed on the display 28 of the terminal device 2, the user inputs the sewing start command by depressing the switch 47. When, in accordance with an operation F6 by the user, the sewing start command has been detected (yes at S45), the CPU 61 transmits a sewing start notification to the terminal device 2 (S46).

The CPU 21 of the terminal device 2 stands by until the CPU 21 receives the sewing start command from the sewing machine 1 (no at S20), and when the sewing start command has been received (yes at S20), the CPU 21 updates the monitoring status displayed on the display 28 to "Sewing" (S21).

The CPU 61 of the sewing machine 1 starts processing to sew the embroidery pattern edited in accordance with the edit operation, based on the sewing data B2 for which the reception is started at S34, and the edit data B4 received at S38 (S47). The CPU 61 according to the present embodiments sews the embroidery pattern based on the corrected data B3 generated at S41. The CPU 61 drives the movement mechanism 45, the needle bar mechanism 18, and the shuttle mechanism in accordance with the needle drop position data, and sews the embroidery pattern on the sewing object held by the embroidery frame 40, using the sewing needle 7 mounted to the needle bar 6. The CPU 61 determines whether to end the sewing, based on whether, of the needle drop position data of the embroidery pattern, the stitch based on the last needle drop position data in the sewing order has been sewn (S48). When the sewing is not to be ended (no at S48), the CPU 61 determines whether it is a thread replacement timing, based on whether, of the needle drop position data of the partial pattern, the stitch based on the last needle drop position data in the sewing order has been sewn (S56).

When it is not the thread replacement timing (no at S56), the CPU 61 returns the processing to S48. When it is the thread replacement timing (yes at S56), the CPU 61 stops the driving of the movement mechanism 45, the needle bar mechanism 18, and the shuttle mechanism (S57), transmits, to the terminal device 2, a thread replacement notification notifying that it is the timing to replace the thread mounted to the sewing machine 1 to the thread for sewing the partial pattern that is next in the sewing order, and causes the red LED 48 to be illuminated (S58). The illumination of the red LED 48 indicates that the sewing machine 1 is currently stopped during the sewing, due to thread replacement or the like. The CPU 61 returns the processing to S45. When the sewing is to be ended (yes at S48), the CPU 61 stops the driving of the movement mechanism 45, the needle bar mechanism 18, and the shuttle mechanism (S49). The CPU 61 transmits, to the terminal device 2, a completion notification notifying that the sewing of the embroidery pattern based on the sewing data for which the reception is started at S34 is complete, and controls the speaker 49 to output a completion buzzer (S50). The CPU 61 causes the green LED 48 to flash (S51).

The CPU 21 of the terminal device 2 determines whether the thread replacement notification has been received from the sewing machine 1 (S22). When the thread replacement notification has been received (yes at S22), the CPU 21 updates the monitoring status displayed on the display 28 to "Stopped," and, based on the sewing data acquired at S3, displays the thread color of the partial pattern that is next in the sewing order on the display 28 (S23). The CPU 21 returns the processing to S20. After mounting the thread, to the sewing machine 1, of the thread color displayed on the display 28 of the terminal device 2, the user inputs a sewing command by depressing the switch 47, and re-starts the sewing. When the thread replacement notification has not been received (no at S22), the CPU 21 determines whether the completion notification has been received from the sewing machine 1 (S24). When the completion notification has not been received (no at S24), the CPU 21 returns the processing to S22. When the completion notification has been received (yes at S24), the CPU 21 updates the monitoring status displayed on the display 28 to "Sewing complete" (S25). The CPU 21 determines whether to continue to perform the sewing (S26). When, in accordance with an operation F7 by the user, a command to continue the sewing of the embroidery pattern has been detected (yes at S26), the CPU 21 transmits, to the sewing machine 1, a continuation notification notifying that the terminal processing and the sewing machine processing are to be continued (S30), and returns the processing to S1. When the command to continue the sewing has not been detected (no at S26), the CPU 21 transmits, to the sewing machine 1, an end notification notifying that the terminal processing and the sewing machine processing are to be ended (S27).

The CPU 61 of the sewing machine 1 determines whether the end notification has been received from the terminal device 2 (S52). When the continuation notification and not the end notification has been received (no at S52), the CPU 61 returns the processing to S31. When the end notification has been received (yes at S52), the CPU 61 deletes each of the sewing data for which the reception is started at S34, the edit data received at S38, and the corrected data generated at S41 (S53). The CPU 61 extinguishes the LED 48 (S54), and transmits, to the terminal device 2, a deletion notification notifying that the data has been deleted by the processing at S53 (S55). The CPU 61 thereby ends the sewing machine processing.

The CPU 21 of the terminal device 2 stands by until the terminal device 2 receives the deletion notification from the sewing machine 1 (no at S28). When the deletion notification has been received from the sewing machine 1 (yes at S28), the CPU 21 ends the monitoring of the sewing machine 1 (S29), and thereby ends the terminal processing.

The system 4 according to the above-described embodiment is provided with the sewing machine 1 and the terminal device 2. The sewing machine 1 includes the sewing portion 68 capable of sewing the embroidery pattern, and the CPU 61. The terminal device 2 includes the input portion 29 and the CPU 21. The CPU 21 of the terminal device 2 acquires the sewing data including the needle drop position data indicating the needle drop positions when sewing the embroidery pattern using the sewing machine 1 (S3). The CPU 21 receives, on the input portion 29, the edit operation that edits the embroidery pattern (S8). Before ending the processing at S8, the CPU 21 transmits at least some of the sewing data acquired at S3 to the sewing machine 1 (S7). After starting to transmit the at least some of the sewing data at S7, the CPU 21 transmits the edit data corresponding to the edit operation received at S8 to the sewing machine 1 (S13). The CPU 61 of the sewing machine 1 starts to receive the sewing data transmitted by the processing at S7 (S34). The CPU 61 receives the edit data transmitted by the processing at S13 (S38). The CPU 61 sews the edited embroidery pattern based on the sewing data and the edit data (S47). The terminal device 2 of the system 4 transmits the sewing data to the sewing machine 1 in advance, during the editing of the embroidery pattern, and transmits separate edit data to the sewing machine 1 after completion of the editing. The terminal device 2 starts to transmit the sewing data before the completion of the editing of the embroidery pattern. Thus, the terminal device 2 starts to transmit the sewing data earlier than in the known art, and the sewing machine 1 starts to receive the sewing data earlier than in the known art. Thus, even when the volume of the sewing data is comparatively large, by executing the processing at S7, S13, S33 and S37, the sewing machine 1 and the terminal device 2 contribute to reducing a stand-by time of the user from the completion of the editing until the start of the sewing.

The processing at S7 is started after the acquisition of the sewing data by the processing at S3 is complete. The processing at S8 is started after the start of the processing to transfer at least some of the sewing data at S7 to the sewing machine 1. By starting the transmission of the sewing data before the start of the edit reception processing at S8, the terminal device 2 of the system 4 contributes to starting the transmission of the sewing data at an earlier timing compared to when the transmission of the sewing data is started after the start of the edit reception processing.

When the reception of the sewing data by the processing at S34 is complete and the reception of the edit data by the processing at S38 is not complete, the sewing machine 1 does not perform the processing to start the sewing until the reception of the edit data is complete, and performs the processing to start the sewing after the reception of each of the sewing data and the edit data is complete (S47). The terminal device 2 of the system 4 contributes to avoiding sewing the embroidery pattern in which the editing content represented by the edit data is not reflected.

The CPU 61 of the sewing machine 1 generates the corrected data based on the needle drop position data and the edit data (S41). In the processing at S47, the CPU 61 sews the embroidery pattern based on the corrected data generated at S41. The sewing machine 1 of the system 4 sews the embroidery pattern based on the corrected data, and thus, even when the edit data specifies relatively complex editing, the sewing machine 1 contributes to sewing the embroidery pattern edited based on the edit data using simple processing, compared to a case in which the corrected data is not generated.

The edit data includes the size data indicating the size of the embroidery pattern. In the processing at S41, the CPU 61 of the sewing machine 1 generates the corrected data to sew the embroidery pattern of the size indicated by the size data, based on the needle drop position data and the size data. The sewing machine 1 of the system 4 contributes to simplifying the processing to sew the embroidery pattern of the size indicated by the size data, compared to a case in which the corrected data is not generated based on the needle drop position data and the size data. The sewing machine 1 contributes to improving a degree of freedom of the editing of the embroidery pattern, compared to a case in which the size of the embroidery pattern cannot be specified.

The edit data includes the angle data indicating the angle of the embroidery pattern with respect to the reference angle. In the processing at S41, the CPU 61 of the sewing machine 1 generates the corrected data to sew the embroidery pattern of the angle indicated by the angle data, based on the needle drop position data and the angle data. The sewing machine 1 of the system 4 contributes to simplifying the processing to sew the embroidery pattern of the angle indicated by the angle data, compared to a case in which the corrected data is not generated based on the needle drop position data and the angle data. The sewing machine 1 contributes to improving the degree of freedom of the editing of the embroidery pattern, compared to a case in which the angle of the embroidery pattern cannot be specified with respect to the reference angle.

The edit data includes the position data indicating the position of the embroidery pattern with respect to the reference position. In the processing at S41, the CPU 61 of the sewing machine 1 generates the corrected data to sew the embroidery pattern at the position indicated by the position data, based on the needle drop position data and the position data. The sewing machine 1 of the system 4 contributes to simplifying the processing to sew the embroidery pattern at the position indicated by the position data, compared to a case in which the corrected data is not generated based on the needle drop position data and the position data. The sewing machine 1 contributes to improving the degree of freedom of the editing of the embroidery pattern, compared to a case in which the position of the embroidery pattern cannot be specified with respect to the reference position.

When, after the start of the processing at S8, the CPU 21 receives the cancellation command to cancel the sewing of the embroidery pattern (yes at S11), the CPU 21 transmits the cancellation command to the sewing machine 1 (S12). When the CPU 61 has received the cancellation command (yes at S35), the CPU 61 invalidates the data already received from the terminal device 2 (S36), and does not perform the processing at S47 based on the data that has already been received. When the cancellation command has been received, the sewing machine 1 of the system 4 contributes to avoiding the embroidery pattern from being sewn based on the sewing data already transmitted to the sewing machine 1.

The sewing data acquired by the processing at S3 includes the thread color data indicating the color of the thread. In the processing at S7, the CPU 61 transmits, to the sewing machine 1, at least some of the needle drop position data in the sewing data after ending the processing at S3 and before ending the processing at S8 (S7), and does not transmit the thread color data to the sewing machine 1. The CPU 21 of the terminal device 2 performs the processing to notify the color of the thread to be used in the sewing, based on the thread color data (S16, S23). The terminal device 2 of the system 4 contributes to reducing the volume of the sewing data transmitted to the sewing machine 1 by an amount corresponding to not transmitting the thread color data. The user can verify the thread color to be mounted to the sewing machine 1 using the message 89 displayed on the display 28.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

The sewing system, the non-transitory computer-readable medium and the sewing machine according to the present disclosure are not limited to the above-described embodiment, and various modifications may be added insofar as they do not depart from the scope and gist of the present disclosure. For example, the following modifications may be added as appropriate.

Various modifications can be made to the present disclosure. For example, the present disclosure can be implemented in various forms, such as a sewing method performed by the sewing system, a sewing data transmission method performed by a device processor of the terminal device, and a sewing control method performed by the sewing machine 1. The system 4 may be provided with the server 3. The communication method between the sewing machine 1 and the terminal device 2 may be wireless communication, or may be wired communication.

(A) The configuration of the sewing machine 1 may be changed as appropriate. As long as the sewing machine 1 is configured to execute embroidery sewing, the sewing machine 1 may be an industrial sewing machine, a multi-needle sewing machine, or an embroidery sewing machine for professional use. The configuration of the terminal device 2 may be changed as appropriate, and the terminal device 2 may be a PC, a smartphone, or the like, for example. The sewing machine 1 may be provided with at least one of a display or an input portion. As long as the display 28 of the terminal device 2 is configured to display an image, the display 28 may be an organic EL display, a plasma display, a plasma tube array display, an electronic paper display using electrophoresis or the like, for example. The input portion 29 of the terminal device 2 may be a keyboard, a mouse, a joystick, and the like, in addition to the touch screen.

Figure 3:
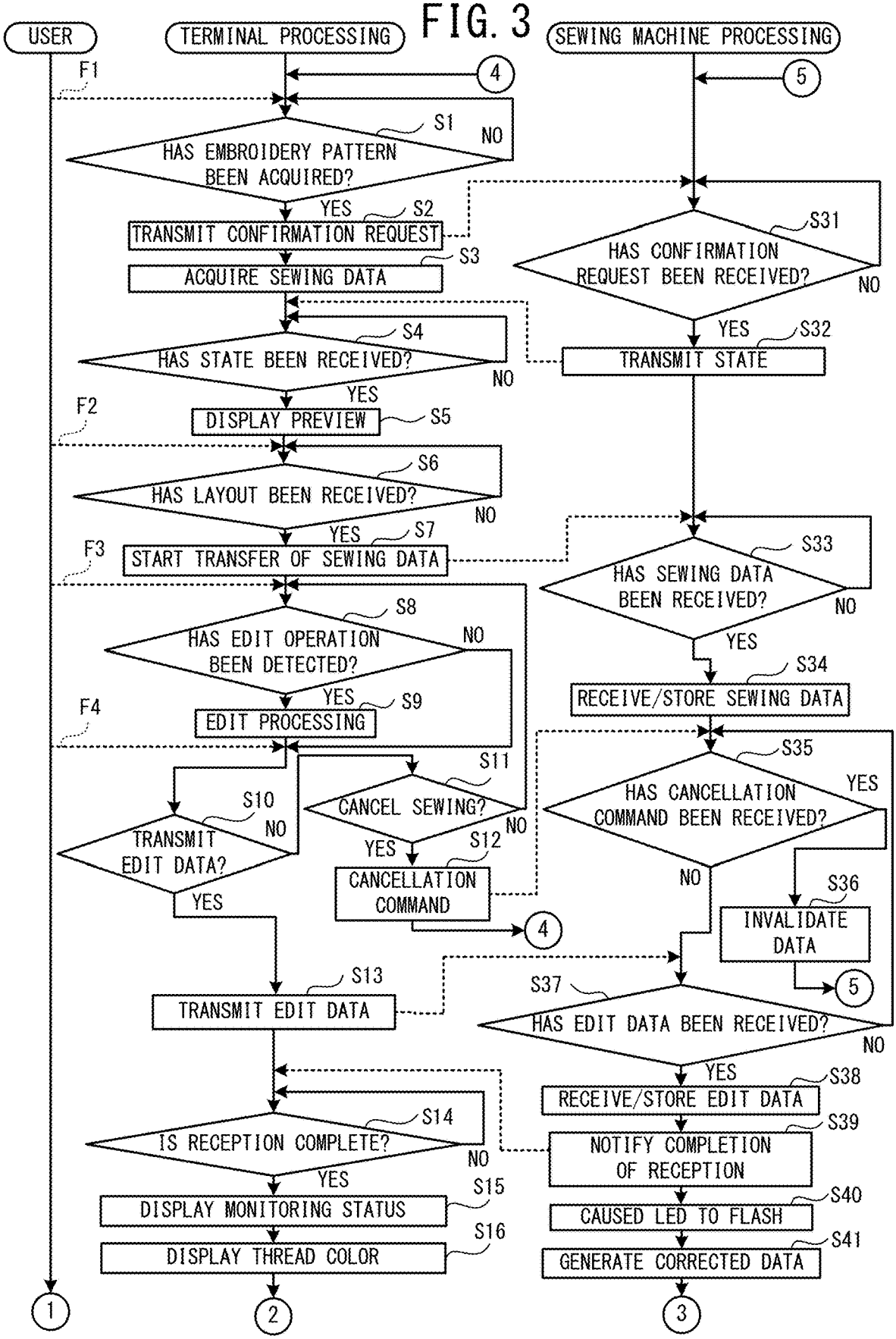
FIG. 3 is a flowchart of terminal processing and sewing machine processing performed by the sewing system.
Figure 4:
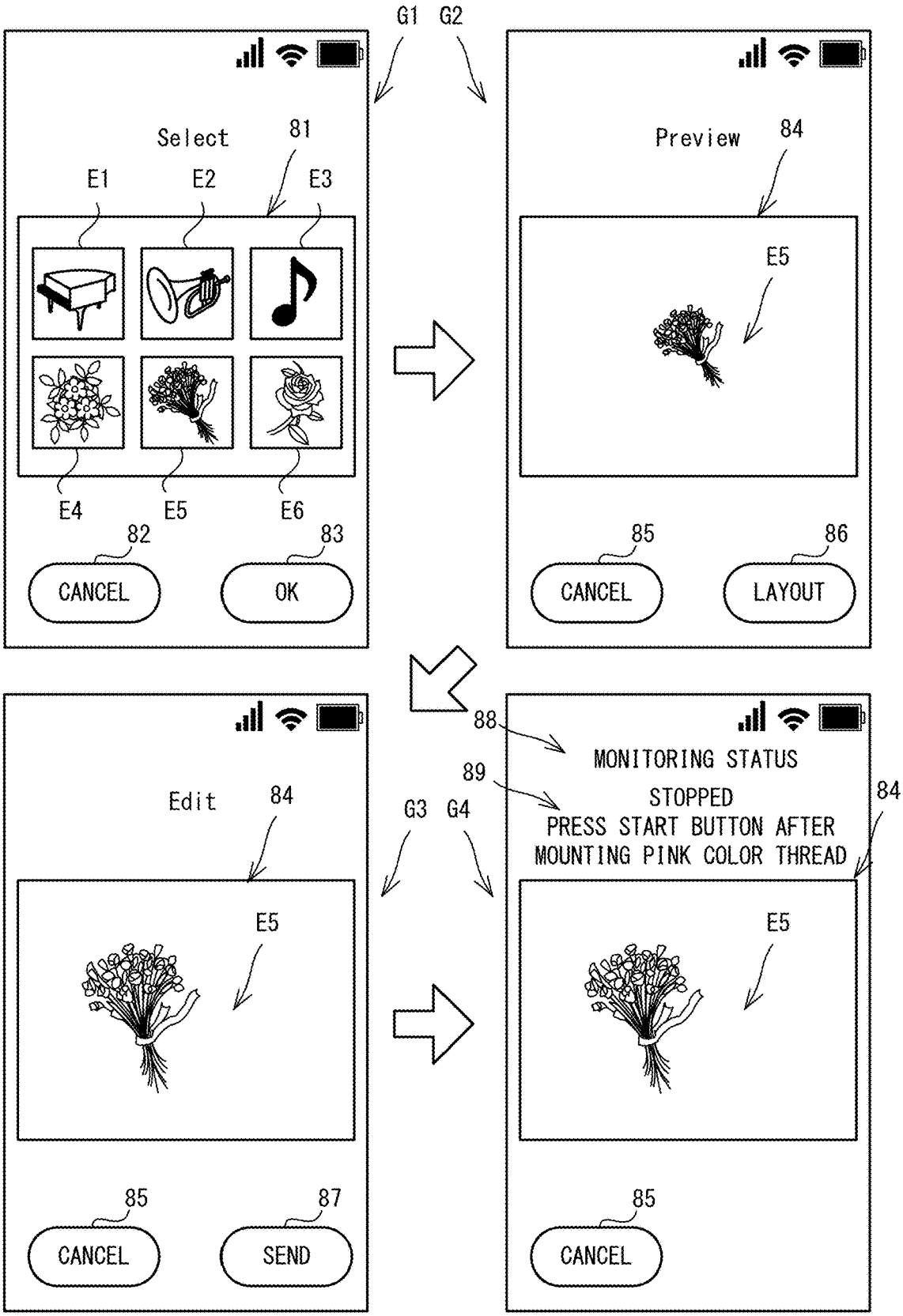
FIG. 4 is an explanatory diagram of transitions of screens displayed on a display portion of the terminal device.

(B) It is sufficient that a program including instructions for executing the processing shown in FIG. 3 and FIG. 5 be stored in a storage device of each of the devices until each of the CPU 21 of the terminal device 2 and the CPU 61 of the sewing machine 1 provided in the system 4 execute the corresponding program. Thus, an acquisition method of the program, an acquisition path, and each of devices storing the program may be changed as appropriate. The program executed by each of the devices may be acquired from another device via a cable or via wireless communication, and stored in a storage device, such as a storage or the like. The other device includes a PC, and server connected via a network, for example.

(C) Each of the steps of the terminal processing is not limited to the example of being executed by the CPU 21, and some or all of the steps may be executed by another electronic device (an ASIC, for example). In a similar manner, each of the steps of the sewing machine processing is not limited to being executed by the CPU 61, and some or all of the steps may be executed by another electronic device. Each of the steps of the terminal processing and the sewing machine processing may be executed by distributed processing by a plurality of electronic devices (a plurality of CPUs, for example). An order of each of the steps of the terminal processing and the sewing machine processing can be changed as necessary, or a step can be omitted or added as necessary. The following modifications may be added to the terminal processing and the sewing machine processing as appropriate.

The CPU 21 of the terminal device 2 may start the processing at S7 after starting the processing to acquire the sewing data at S3, at a stage at which the acquisition of the sewing data is not ended. The CPU 61 of the sewing machine 1 may start the processing at S47 after the start of the processing at S13, at a stage at which the processing at S13 is not ended. For example, when setting the edit data for each of the partial patterns, as long as there is the edit data of the partial pattern sewing data that is first in the sewing order, it is possible to perform the sewing using the corrected data corrected based on the edit data, even when the reception of the edit data of the partial pattern sewing data that is second in the sewing order is not complete. Thus, the CPU 61 may sew the partial pattern that is first in the sewing order and that has been edited in accordance with the edit operation, based on the first partial pattern sewing data and the edit data, at a time point at which the reception of the edit data of the partial pattern sewing data that is first in the sewing order is complete.

At S47, the CPU 61 may sew the edited embroidery pattern based on the sewing data and the edit data, without generating the corrected data. For example, when editing only the position of the embroidery pattern in accordance with the edit operation, and when the needle drop position data are not represented by the absolute coordinates but by relative coordinates (a movement amount) with respect to a needle drop point that is one previous in the sewing order, as long as the CPU 61 performs the sewing in accordance with the sewing data for which the reception is started at S34, after the sewing start position is moved based on the edit data received at S38, the CPU 61 can sew the embroidery pattern at the edited position without generating the corrected data.

The CPU 21 may omit the processing at S10 and S11, and need not necessarily receive the input of the cancellation command. In this case, the CPU 61 may omit the processing at S35 and S36. At S36, the processing to invalidate the data may be changed as appropriate, and the CPU 61 may overwrite and invalidate the already received sewing data and edit data using the sewing data and the edit data received at the subsequent S34 and S38, or may invalidate the sewing data and the edit data by moving the sewing data and the edit data to a deletion candidate folder. The CPU 61 may omit the processing at S39 as appropriate. In this case, the CPU 21 may execute the processing at S15 after the CPU 21 transmits the edit data to the sewing machine 1 at the processing S13, for example.

The edit operation may be changed as appropriate. For example, the CPU 21 may receive the edit operation by detecting selection of a key instructing an angle change, a change in position, or a change in size. The type of the editing in accordance with the edit operation may be changed as appropriate, and the edit data may be data including data of one or more data selected from among the angle data, the position data, and the size data, for example. A definition of the size of the embroidery pattern may be modified as needed. For example, the size of the embroidery pattern may be represented by a diameter of the smallest circle or oval that encompasses the pattern. The size data may represent the X length or the Y length. The CPU 61 may receive the change in the thread color, and, in this case, the edit data need not necessarily include the thread color data. The CPU 21 of the terminal device 2 may transmit, to the sewing machine 1, the sewing data including the thread color data. When the sewing machine 1 includes a display portion, the processing to display the thread color of the thread that is next in the sewing order may be performed on the sewing machine 1 and not on the terminal device 2. The CPU 21 may transmit the sewing data and the edit data of one embroidery pattern to the sewing machine 1, and may perform the terminal processing for a next embroidery pattern while the processing is being performed in the sewing machine 1 to sew the embroidery pattern edited based on the sewing data and the edit data. When the terminal device 2 is provided with a speaker, the CPU 21 may perform notification of the thread color using audio, in the processing at S16 and S23.

The above-described modified examples may be combined insofar as no contradictions arise. In addition to combinations exemplified in the scope of the claims, an applicant of the present application has the intention of acquiring patent rights for combined aspects, insofar as they do not depart from the scope and gist of the present disclosure, and insofar as no contradictions arise.

What is claimed is:

1. A sewing system including a sewing machine and a terminal device capable of communicating with the sewing machine, wherein the terminal device includes an input portion, a device processor, and a device memory storing computer-readable instructions that, when executed by the device processor, instruct the device processor to perform processes comprising:

acquiring sewing data including needle drop position data representing needle drop positions in sewing an embroidery pattern with the sewing machine;

receiving an edit operation, on the input portion, to edit the embroidery pattern;

transmitting, to the sewing machine, at least some of the sewing data, during the receiving the edit operation; and transmitting, to the sewing machine, edit data according to the edit operation, after starting the transmitting the at least some of the sewing data, and the sewing machine includes a needle bar configured to move up and down, a sewing processor, and a sewing memory storing computer-readable instructions that, when executed by the sewing processor, instruct the sewing processor to perform processes comprising:

receiving the sewing data transmitted by the terminal device;

receiving the edit data transmitted by the terminal device; and controlling the needle bar to perform sewing the embroidery pattern edited in accordance with the edit operation, based on the sewing data and the edit data after reception both of the sewing data and the edit data is complete.

2. The sewing system according to claim 1, wherein the transmitting the at least some of the sewing data is started after the acquiring the sewing data, and the receiving the edit operation is started after starting the transmitting the at least some of the sewing data.

3. The sewing system according to claim 1, wherein in a case where the reception of the sewing data by the receiving the sewing data is complete and the reception of the edit data by the receiving the edit data is not complete, the computer-readable instructions stored in the sewing memory instruct the sewing processor to not perform the sewing the embroidery pattern based on the sewing data and the edit data until the reception of the edit data is complete.

4. The sewing system according to claim 1, wherein the computer-readable instructions stored in the sewing memory further instruct the sewing processor to further perform a process comprising:

generating corrected data in which the needle drop position data are corrected based on the edit data, and the sewing the embroidery pattern includes sewing the embroidery pattern based on the corrected data.

5. The sewing system according to claim 4, wherein the edit data includes size data indicating a size of the embroidery pattern, and the generating the corrected data includes generating the corrected data to sew the embroidery pattern of the size indicated by the size data, based on the needle drop position data and the size data.

6. The sewing system according to claim 4, wherein the edit data includes angle data indicating an angle of the embroidery pattern with respect to a reference angle, and the generating the corrected data includes generating the corrected data to sew the embroidery pattern at the angle indicated by the angle data, based on the needle drop position data and the angle data.

7. The sewing system according to claim 4, wherein the edit data includes position data indicating a position of the embroidery pattern with respect to a reference position, and the generating the corrected data includes generating the corrected data to sew the embroidery pattern at the position indicated by the position data, based on the needle drop position data and the position data.

8. The sewing system according to claim 1, wherein the computer-readable instructions stored in the device memory further instruct the device processor to perform a process comprising:

in a case where a cancellation command to cancel the sewing of the embroidery pattern is acquired after starting the receiving the edit operation, transmitting the cancellation command to the sewing machine, and the computer-readable instructions stored in the sewing memory further instruct the sewing processor to perform a process comprising:

in a case where the cancellation command is received, invalidating data already received from the terminal device, and not performing the sewing the embroidery pattern based on the already received data.

9. The sewing system according to claim 1, wherein the sewing data acquired by the acquiring the sewing data includes thread color data indicating a color of a thread, the transmitting the at least some of the sewing data includes transmitting, to the sewing machine, at least some of the needle drop position data, of the sewing data, after the acquiring the sewing data, and before terminating the receiving the edit operation, and not transmitting the thread color data to the sewing machine, and the computer-readable instructions stored in the device memory further instruct the device processor to perform a process comprising:

notifying, based on the thread color data, the color of the thread to be used in the sewing.

10. A non-transitory computer-readable medium storing computer-readable instructions that are executed by a device processor of a terminal device including an input portion and the device processor, the computer-readable instructions instructing the device processor to perform processes comprising:

acquiring sewing data including needle drop position data representing needle drop positions in sewing an embroidery pattern with a sewing machine;

receiving an edit operation, on the input portion, to edit the embroidery pattern;

transmitting, to the sewing machine, at least some of the sewing data, during the receiving the edit operation; and transmitting, to the sewing machine, edit data according to the edit operation, after starting the transmitting the at least some of the sewing data.

* * * * *